US006880276B2

(12) United States Patent
Strein et al.

(10) Patent No.: US 6,880,276 B2
(45) Date of Patent: Apr. 19, 2005

(54) TRANSPARENT ELECTRONIC ILLUMINATED DISPLAY

(75) Inventors: Walter Strein, 725 W. 10th St., Bonham, TX (US) 75418; Martin L. Yun, Pine Bluff, AR (US)

(73) Assignee: Walter Strein, Bonham, TX (US)

( * ) Notice: Subject to any disclaimer, the term of this patent is extended or adjusted under 35 U.S.C. 154(b) by 67 days.

(21) Appl. No.: 10/462,123

(22) Filed: Jun. 16, 2003

(65) Prior Publication Data

US 2004/0250457 A1 Dec. 16, 2004

(51) Int. Cl.[7] ..... G09F 13/00

(52) U.S. Cl. ..... 40/442; 40/541; 385/901; 385/115

(58) Field of Search ..... 40/442, 444, 541, 40/581, 591, 592, 593; 385/901, 115, 116, 385/120, 121, 32

(56) References Cited

U.S. PATENT DOCUMENTS

| | | | | |
|---|---|---|---|---|
| 4,067,128 A | | 1/1978 | Kempster | 40/473 |
| 4,574,269 A | * | 3/1986 | Miller | 362/503 |
| 4,860,476 A | | 8/1989 | Hall | 40/593 |
| 5,064,708 A | | 11/1991 | Azulay | 428/156 |
| 5,132,666 A | | 7/1992 | Fahs | 340/468 |
| 5,151,679 A | | 9/1992 | Dimmick | 340/326 |
| 5,438,780 A | | 8/1995 | Winner | 40/514 |
| 5,636,462 A | * | 6/1997 | Kleiman | 40/452 |
| 5,657,566 A | | 8/1997 | Key | 40/590 |
| 5,731,755 A | | 3/1998 | Boxer | 340/465 |
| 5,818,998 A | * | 10/1998 | Harris et al. | 385/100 |
| 6,060,993 A | | 5/2000 | Cohen | 340/691.6 |
| 6,118,418 A | | 9/2000 | Johnson et al. | 345/84 |
| 6,178,677 B1 | * | 1/2001 | Williams | 40/593 |
| 6,195,016 B1 | | 2/2001 | Shankle et al. | 340/815.42 |
| 6,198,872 B1 | | 3/2001 | Lipson et al. | 385/901 |
| 6,236,330 B1 | | 5/2001 | Cohen | 340/691.6 |
| 6,271,814 B1 | * | 8/2001 | Kaoh | 345/82 |
| 6,371,637 B1 | | 4/2002 | Atchinson et al. | 362/555 |
| 6,446,375 B1 | | 9/2002 | Davis | 40/597 |
| 6,571,043 B1 | * | 5/2003 | Lowry et al. | 385/120 |
| 2003/0113088 A1 | * | 6/2003 | Takeya et al. | 385/136 |

* cited by examiner

*Primary Examiner*—Gary C. Hoge
(74) *Attorney, Agent, or Firm*—Christopher J. Whewell

(57) ABSTRACT

The present invention provides an illuminated electronic display which in one preferred form employs LED's to form characters in a message that is desired to be displayed to an intended viewer. A display of the invention is translucent, and is thus suitable for placement in locations which precluded locating illuminated electronic displays of the prior art in those same locations by virtue of the opaqueness of the displays of the prior art. A display means according to the invention may be placed in the rear window of an automobile, without adversely impacting the drivability of the vehicle owing to the translucency of the display. Other window locations are suitable for employment of a device according to the invention as well.

15 Claims, 5 Drawing Sheets

TRANSPARENT ELECTRONIC ILLUMINATED DISPLAY

TECHNICAL FIELD

The present invention relates generally to devices and systems associated therewith useful for making visual displays. More particularly, it relates to means and systems for displaying a variety of text messages and images, as in the cases of advertising or general message communication. A device according to the present invention is especially well suited to be disposed in a window of a motor vehicle or dwelling.

BACKGROUND INFORMATION

The advent of electric lighting introduced various lighted display means for providing messages capable of being illuminated during non-daylight hours. One early method of providing illuminated signage was through the use of a high voltage discharge through an inert gas, with neon being particularly preferable, as is well-known in the art. Another early method involved the use of a plurality of incandescent lamps arranged in a selected pattern, which were intermittently flashed on and off so as to produce a visual effect resembling the movement of words from one portion of the pattern to another, for example from right to left, to simulate the movement of words such as an advertising slogan.

In recent times, illuminated signage has also found widespread usage on motorized vehicles, such as buses, commuter trains, billboards, and taxicabs, to name but a few. Since advertising is a lucrative field, particularly in areas of high population densities such as large cities, several workers have provided patented advances in this art. A few patents relating to such advertising or other means for displaying messages are now mentioned as background information, and the entire contents of each of these are herein incorporated by reference thereon.

U.S. Pat. No. 4,067,128 teaches an indicator for a taxi cab, which comprises: a) a housing having at least one window through which can be displayed; b) a means to fix the housing to an exterior surface of the vehicle; c) a rotatable indicator having a plurality of positions to display alternate information relating to the condition of the taxi; d) a means to move the indicator through a limited arc, which includes a pair of solenoids interconnected by a rod forming the armature for the solenoids; e) a pair of spaced guides attached to and projecting from the rod to slidably engage therebetween a crank pin on a crank mounted on the indicator, wherein the solenoids move the rod longitudinally from a central position, whereby the rod movement causes partial rotation of the indicator to its the positions.

U.S. Pat. No. 4,860,476 provides message display apparatus for an automobile window comprising: a) a display member assembly comprised of a housing, wherein the housing has a display board, an array of holes, a reflective back, and passive pin lights in each hole of the array of holes; b) a transparent lens located in front of the display board; c) a peripheral recess formed around the front of the housing to accommodate the display member assembly and transparent lens; d) a means for mounting the housing and display member assembly adjacent to an automobile window; and e) means for illuminating the display member assembly.

U.S. Pat. No. 5,132,666 sets forth a display and mounting deck combination, comprising: a) a rectilinear, adjustable mounting deck adapted to connect to a roof portion of a vehicle, including slidably adjustable side arms for adjusting a center mounting area of the mounting deck to fit different sizes of displays, wherein each of the adjustable side arms further include two slidable frames having hollow track sections slidable upon a middle bar; b) a tensioning means attached to the adjustable side arms to provide slidable adjusting tension to the adjustable side arms, wherein the tensioning means includes an adjustable tensioning spring; c) a variable information display supported by the mounting deck; and d) a fixed information display mounted to the variable information display.

U.S. Pat. No. 5,151,679 shows a sign comprising at least one light pipe of a suitable material of uniform index of refraction having a longitudinal axis of extension, which is made of light-transmitting material, and which has two ends and carries at least one light source that is a light-emitting diode that is disposed proximate at one end wherein the light source is contained in the end. The light source is directed towards the other end of the light pipe in the direction of the longitudinal axis of extension of the light pipe. A portion of the outer surface of the light pipe is translucent and permits light to exit therefrom. The sign further carries an electrical circuit means for energizing the light source, and a means for mounting the light pipe to display the predetermined message or design. Energizing the light source causes light to be transmitted in the light pipe, and light therefrom emerging through the translucent outer surface of the light pipe yields a display of the predetermined message or design.

U.S. Pat. No. 5,438,780 details an information display apparatus, comprising: a) an elongated roller; b) a screen of soft material that can be wound up on the roller attached at one side of the screen to the roller; c) a bar attached to the screen on a second side of the screen opposite to the roller; d) at least one folding arm connected between the bar and a member which is fixed adjacent to and relative to the roller; e) a spring-biasing means for extending the at least one folding arm and, thereby, separating the bar from the roller such that the screen is unwound from the roller to a fully-extended position solely by the force of the spring-biasing means; f) a means for rotating the roller such that the screen is wound around the roller and the bar is moved towards the roller against the direction of the bias of the spring-biasing means; g) a means for attaching the apparatus to a roof rack of a vehicle. The screen is formed out of a net fabric having sufficiently-sized holes therethrough that there is a visibility through the screen and such that air can readily pass through the screen, even when the screen is attached to a vehicle and driven in road use. The apparatus includes at least one warning light mounted on the bar, and the bar is at a position substantially vertically above the roller.

U.S. Pat. No. 5,657,566 provides rapid mount advertising panels for motor vehicles that comprise a plurality of panels having a first and last panel. Each of the panels containing a top portion, a bottom portion, a center portion, a back side, a front, a central retaining plate and cavity located on the back side of each of the panels, wherein the central cavity has a top and a bottom. There is at least one bottom retaining plate and bottom cavities located on the front and near the bottom portion of each of the panels. Each of the bottom cavities has a top and a bottom. There is an air foil means attached to the front and back side respectively of the first and last panels, and an upper bracket means for receiving and securing the top portion of each of the panels. There is a central bracket means for engaging and securing the center portion of each of the panels, and lower bracket means for receiving and securing the bottom portion of each of the panels. Also provided are latching and locking means for latching the bottom portion of each of the panels, and locking means for locking the bottom latching means.

U.S. Pat. No. 5,905,434 discloses a vehicle communications system having a remote control unit installed in the interior of a vehicle and a display unit located on the exterior of the vehicle. The display unit has an input from the remote control unit and an input from a vehicle interface module that has inputs from the vehicle such as the braking system and the turning signal system. The remote control unit is controllable by the driver in the vehicle and has a table of preset and preprogrammed messages selectable by the driver. The driver selects a message to be displayed and sends the message to the display unit. Any input to the vehicle interface module from the vehicle signaling systems overrides the signal input from the remote control unit unless the display unit is mounted on the front of the vehicle. The driver can select a message from a table of messages that are sequentially displayed on the remote control unit. The table of messages is stored on a flash memory in the remote unit and in a flash memory in the display unit. The table of messages in the remote unit is programmable via a USB programming port. The table of messages in the display unit can be programmed via an RF signal sent to the display unit by the remote unit.

U.S. Pat. No. 6,060,993 sets forth a mobile system for conveying messages, which comprises a vehicle adapted to traverse a geographic region, wherein the region is segregated into zones. It includes a display carried by the vehicle, and a controller associated with the vehicle, wherein the controller is operably connected to the display. The controller drives the display to generate a publicly viewable message selected for a first zone within which the vehicle is located. There is a means operably connected to the controller for generating signals indicative of the geographic location of the vehicle, wherein the controller receives the signals indicative of the geographic location of the vehicle and determines when the vehicle has entered a different zone for which the message has not been selected for display, and driving the display to generate a different message selected for display in the different zone.

U.S. Pat. No. 6,118,418 shows a pixel for use in a visual matrix display comprising: a) a frame having front and rear surfaces, and defining an aperture; b) a light source oriented in the aperture; c) a first retroreflective surface borne by the frame and positioned adjacent to the aperture; d) a flap borne by the front surface and moveable along a given path of travel between a first position wherein the pixel is non-operational, and the flap is disposed in covering relation relative to the light source, and the first retroreflective surface, to a second operational position, and wherein the flap has a second retroreflective surface which is exposed when the flap is oriented in the second position; e) means borne by the frame for selectively moving the flap along the given path of travel; and f) means for energizing the light source when the flap is in one of the given positions along the path of travel.

U.S. Pat. No. 6,195,016 details a fiber optic display system comprising: a) a plurality of fiber optics having first and second ends, wherein the first ends are arranged in a bundle to receive an image, and wherein the fiber optics couple an image to the second ends thereof for displaying the image wherein the spacing between the second ends of the fiber optics is greater than the spacing between the first ends in the bundle; b) an image generator that generates an image received by the first ends of the fiber optics; and c) an array of lenses for receiving light from the second ends of the fiber optics, wherein the lenses aim the light from the fiber optics to control the viewing angle of the image displayed.

U.S. Pat. No. 6,198,872 provides a programmable display device comprising: a) a panel having opposed front and rear faces and a plurality of apertures extending therethrough; b) a plurality of optical fibers, wherein each the optical fiber having an emitting end and a receiving end, the emitting ends of the optical fibers being mounted in the respective apertures such that the receiving ends of the optical fibers are spaced from the rear face of the panel; c) a plurality of LED's, each LED being connected in juxtaposed to the receiving at least one optical fiber; and d) a control circuit for generating a programmed sequence of signals for selectively illuminating the LED's, such that the LED's direct light into the receiving end of each the optical fiber connected thereto, and such that light from the respective light emitting diodes are directed through the optical fibers and from the emitting ends of the optical fibers at the front face of the display panel.

U.S. Pat. No. 6,236,330 teaches a mobile system for conveying messages, which includes: a) a display; b) a transporter associated with the display for moving the display from one location to another; c) a controller associated with the display for driving the display to generate a visual message; d) a fixed station located remote from the display; e) an advertiser located remote from the display; f) a communications link between the advertiser and the station for transmitting visual message content and scheduling data from the advertiser to the station; and g) a communications link between the station and the controller for transmitting visual message content and scheduling data. The controller drives the display to generate the visual message content pursuant to the scheduling data.

U.S. Pat. No. 6,265,984 discloses a pre-programmed device for displaying images, comprising: a) a plurality of electrically powered light emitters in one or more generally continuous rows, wherein the display device is capable of being moved in a path generally perpendicular with the row of lights; b) at least one microprocessor, wherein the light emitters are under direct control of at least one microprocessor; c) at least one motion or speed sensor within the display device; d) a source of electrical power within, on, or connected to the display device; and e) at least one input/output microprocessor pin on the microprocessor, wherein at least one input/output microprocessor pin drives at least one multicolor light emitting diode; and at least one of the sensors enables the microprocessor. The microprocessor turns individual light emitters on and off in a time-controlled manner, in order that graphics, words or messages are displayed when the display device is moved at or above a rate of speed sufficient to be seen by people.

U.S. Pat. No. 6,371,637 sets forth a flexible, low profile lighting system, comprising: a) a flexible printed circuit board substrate that is flexible through at least two axes of rotation, which substrate is adapted to support and electrically interconnect surface mount electronic components; b) a plurality of surface mount light emitting diodes, wherein the plurality of light emitting diodes are surface mounted on the flexible printed circuit board substrate, so as to define a conformably bendable lighting array configured for mounting upon surfaces with compound curvature substrate. The array outputs a uniform light intensity of at least 2000 millicandles per square centimeter.

Thus, it is seen that display means for displaying text and other messages which employ light emitting diodes ("LED's") have come into popular usage, particularly with recent developments in diode technology which have permitted increased brightness of the LED's.

However, of all of the display means which have been provided by the prior art which are in popular usage, none are suitable for employment in front of, or behind a window through which a person must be able to see during the course of normal daily activity. This is because none of the prior art means for displaying messages are sufficiently translucent to enable a person to see through both the window and a sign disposed in front of the window, either while a message is displayed on the sign or when no message is being displayed. Rather, the display signs of the prior art are all disposed about a black or other opaque background. The use of black or other opaque backgrounds inherently makes such display signs in general unsuitable for being disposed in such locations as the side or rear windows of automobiles or other motorized vehicles, whose drivers by necessity must be able to have uninhibited vision through such windows.

Thus, if a translucent sign means were provided, such would enable the back window of taxicabs to be used for advertising purposes. In addition, disposing a sign in the rear window of a motorized vehicle enables communication between the drivers of the vehicles. The present invention solves this problem, and provides an illuminated sign having an electronically-alterable message that may be disposed in such locations as the rear window of automobiles (or other places where vision through a window is required), thus rendering such locations accessible to advertising and other visual communications and visual effects.

SUMMARY OF THE INVENTION

The invention comprises generally a clear screen in the shape of a rectangular solid having a plurality of holes disposed through or into it to a predetermined depth. There is a lens disposed over each of the holes on the viewing side of the screen, and the back side of the holes are adapted to receive the first end portion of an optical fiber. The second end of the optical fiber is disposed to receive light signals from light emitting diodes disposed in the horizontal base of the unit. From the side cross-sectional view, the screen is tilted with respect to the horizontal, while when viewed in the orientation of its intended use from the perspective of a viewer disposed at even a short distance away, the screen appears rectangular. Owing to its being made from a clear background, such as an acrylic, and owing to the small diameters of the optical fibers, the present invention may be disposed in the rear window of an automobile to enable displays of characters or words to viewers outside of the vehicle while not significantly inhibiting the visibility of the rear window by the driver.

The present invention provides a transparent illuminated display device suitable for mounting in windows and other locations which comprises: a base portion having a bottom surface, a top portion, and a hollow interior portion. There is a light source support having a plurality of light sources disposed on it. There is a fiberoptic guide, which according to one form of the invention is substantially-planar, which has a plurality of holes disposed through its surface. There is a substantially-planar, transparent display array having a plurality of holes disposed through its surface, and the substantially-planar display array is attached to the base portion at the top portion of the base portion, which then causes the substantially planar display array to be disposed at an angle of between 30 and 85 degrees with respect to the horizontal when the base portion of the transparent illuminated display is disposed on a horizontal surface. There are a plurality of fiberoptic strands, and each fiberoptic strand has a first end portion and a second end portion. The first end portion of the fiberoptic strands are disposed in sufficient proximity to one of the light sources that are disposed on the light source support to enable light emitted from the light source to enter the fiberoptic strands. The second end portion of each of the fiberoptic strands is disposed within one of the holes in the display array. Each of the fiberoptic strands pass through one of the holes disposed through said fiberoptic guide, which keeps the fiberoptic strands separate from one another while keeping them in their desired locations.

The display array comprises a front surface and a rear surface, and it is preferred that the fiberoptic strands enter the holes on the display array from or at the rear surface.

In one alternate form of the invention, the second end portion of the fiberoptic strands is flush with the front surface of the display array. In another alternate form of the invention, the second end portion of the fiberoptic strands is recessed with respect to said front surface. In yet another alternate form of the invention the second end portion of the fiberoptic strands protrudes outward from said front surface.

In one form of the invention, there are lenses disposed at the second end portion of the fiberoptic strands. In one form of the invention, the lens is in contact with the display array. In a preferred form of the invention, the lens is affixed to the display array by means of a conventional adhesive, such as an epoxy or a cyanoacrylate.

It is preferred that the display array is transparent to the extent that it absorbs less than 5.0% of visible light passing through a one centimeter length of the display array. Preferably, the plurality of light sources comprise light emitting diodes. Thus, the transparent display array preferably comprises a material selected from the group consisting of: polymethylmethacrylate resins, polyethylethacrylate resins, polycarbonate resins, polyacrylate resins, and glass.

In one form of the invention, the plurality of light sources comprise light emitting diodes and the light emitting diodes are arranged in a rectangular array. In one form of the invention, the plurality of holes disposed through the surface of the transparent display array are arranged in a rectangular array. In one preferred form of the invention, the plurality of holes disposed through the surface of the transparent display array are arranged in a rectangular array.

In an alternate form of the invention, the first portion of at least two of the fiberoptic strands are disposed in sufficient proximity to a single light source so that light from the single light source is caused to enter into both of the at least two fiberoptic strands.

The present invention also provides an automobile, including a device according to the invention disposed in a location selected from the group consisting of: its rear window and its roof, wherein at least one of the plurality of light emitting diodes is in effective electrical contact with the electrical system of the automobile.

One special case of a device according to the invention is that which includes: a base portion having a bottom surface, a top portion, and a hollow interior portion; a light source support having a plurality of light sources disposed thereon, wherein the plurality of light sources comprise light emitting diodes, wherein the light emitting diodes are arranged in a rectangular array. There is a substantially-planar fiberoptic guide having a plurality of holes disposed through its surface, and a substantially-planar, transparent display array having a plurality of holes disposed through its surface, wherein the holes through the surface of the transparent display are arranged in a rectangular array. The substantially-planar display array is attached to the base portion at the top portion of the base portion, such that the substantially planar display array is disposed at an angle of between 30 and 85 degrees with respect to the horizontal when the base portion of the transparent illuminated display is disposed on a horizontal surface. The transparent display array comprises a material selected from the group consisting of: polymethylmethacrylate resins, polyethylethacrylate resins, polycarbonate resins, polyacrylate resins, and glass. There are a plurality of fiberoptic strands, wherein each fiberoptic strand has a first end portion and a second end portion, wherein the first end portion of the fiberoptic strands are disposed in sufficient proximity to one of the light sources disposed on the light source support to enable light emitted from the light source to enter the fiberoptic strands, and wherein the second end portion of each of the fiberoptic strands is disposed within one of the holes in the display array. The fiberoptic strands pass through one of the holes disposed through the fiberoptic guide, and there is a lens disposed at the second end portion of each of the fiberoptic strands.

The invention also provides a process for displaying a character comprising the steps of: i) providing a display device as set forth above and ii) selectively energizing a plurality of the light sources in a pre-selected pattern so as to cause a first image to be displayed on the display array, wherein the first image comprises a character selected from the group consisting of: numbers and letters. The first image may also be caused to cease to exist, and a plurality of the light sources be again energized in a pre-selected pattern so as to cause a second image to be displayed on the display array, wherein the second image is different than the first image.

DETAILED DESCRIPTION

Figure 1:
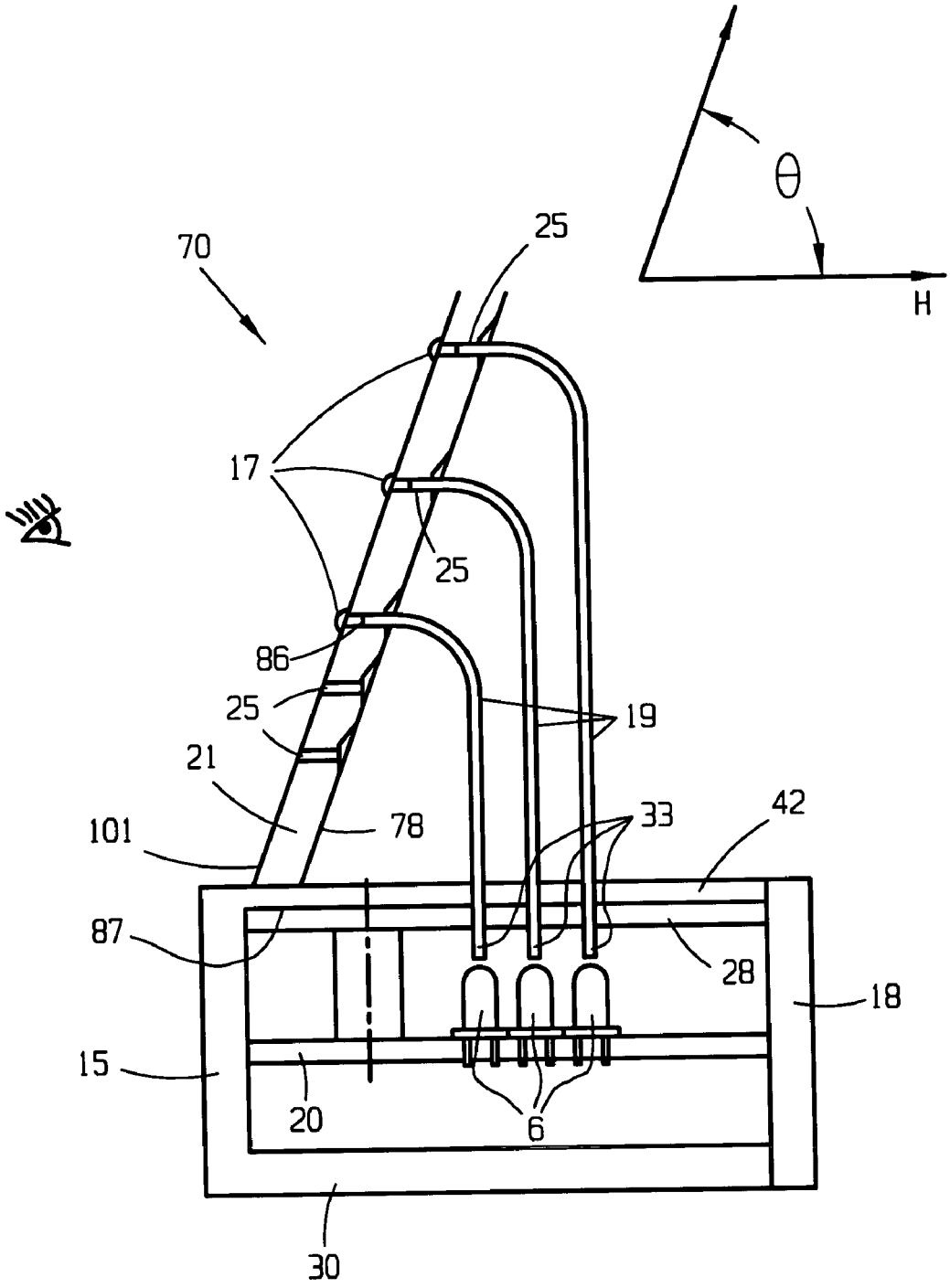
FIG. 1 shows a side schematic view of a transparent display device according to the present invention.

Referring to the drawings and initially to FIG. 1 there is shown a side perspective view of a transparent display device 70 according to the present invention. From FIG. 1 it can be seen that a display according to the invention comprises a base portion which comprises a horizontal frame member 30, which is planar, horizontally disposed, and which serves as the bottom portion of the base of the display as a whole and whose function includes being a structural element of the device. There are also vertical perimeter frame members 15 and 18, which may be planks, boards, or the like whose function is structural support, similar to the horizontal frame member 30. Collectively, the plurality of vertical perimeter frame members define a box-like base, in which the various other elements of the device, as described herein, are housed. There is a light source support 20, which may be a printed circuit board onto which are mounted light sources, such as light-emitting diodes 6. Alternate light sources include any device which may be electrically stimulated to emit light in the visible spectrum, including without limitation, incandescent lamps. According to one preferred form of the invention, the light source support 20 is attached to the vertical perimeter frame members using conventional fastening means which include without limitation adhesives, brackets, nuts and bolts, rivets, etc. There is also shown in FIG. 1 a fiberoptic guide 28, which according to one preferred form of the invention is a perforated board that is opaque. The fiberoptic guide 28 is planar in configuration, and includes a plurality of holes through its surface through which are disposed fiberoptic strands 19. The fiberoptic strands are disposed so that their first end portions 33 are in sufficient proximity to the light-emitting diodes 6 so as to enable light emitted from the light-emitting diodes to enter the first end portions 33 of the fiberoptic strands 19. There is also shown a display array 21, which in one preferred form of the invention is attached to the top portion 87 of the base portion which comprises the horizontal frame member 30 and vertical perimeter frame members 15 and 18. The base portion is thus seen to exist generally in the shape of a rectangular solid, or box configuration, having the horizontal frame member 30 as its floor portion, and the vertical perimeter frame members 15 and 18 as the side wall portions. The top portion of the base portion in one form of the invention comprises the fiberoptic guide 28, however, the invention also comprises an embodiment in which a top cover 42 is disposed atop the fiberoptic guide at the top portion 87 of the base portion, so as to preclude dirt, dust, and other foreign matter from entering the inner confines of the base portion. According to a one preferred form of the invention, the top portion 87 of the base is identical to the top cover, as the top portion 87 is intended to refer to a location on the device of the invention. Preferably, the top portion is flat and parallel to the horizontal frame member 30. The top cover 42 of the base portion is thus flat, and according to one preferred form of the invention is parallel to the horizontal frame member 30. There is a display array 21 which is constructed of a clear stock material, such as an acrylic plastic, polyacrylate, glass, or other rigid material through which visible light may pass. It is the display array 21 which serves as the support for the second end portions of the fiberoptic strands 19. Preferably, the display array 21 is comprised of planar stock, and is attached to the top portion of the base portion so that it makes an angle theta with respect to the horizontal H. The horizontal, for purposes of this specification and the appended claims, has its common meaning, namely parallel to the horizon, as the horizon is understood to be planar. In cases where a device according to the invention is disposed within the rear window of an automobile, the horizon may be defined as the surface upon which the vehicle rests, such as the road or surface the vehicle is on. Preferably, the angle theta is any angle between 30 and 85 degrees. More preferably, this angle is any angle between 45 and 80 degrees. It is most preferred that this angle is 70 degrees. There are a plurality of holes 25 disposed through the display array 21 which preferably correspond in number to the holes in the fiberoptic guide 28, so as to accommodate an equivalent number of fiberoptic strands 19 having their first end portion 33 disposed through a hole the fiberoptic guide 28 to be in close proximity with a light-emitting device, such as LED's 6, and their second end portions disposed in the holes 25 in the display array 21. The holes 25 in the display array 21 are disposed so that the centerlines of their bores are oriented parallel to the top surface of the base portion, which is preferably flat. According to one preferred form of the invention, the angle that the centerlines of the holes 25 are disposed at with respect to the planar surface of the display array is equal to angle theta. Such an arrangement provides for light which exits the second end portions 86 of the fiberoptic strands 19 to be aimed directly towards the eye in FIG. 1, which represents a person. Thus, unlike signs of the prior art whose surfaces are generally disposed perpendicular to the person viewing the sign, the top portion of a display array according to the present invention is preferably angled away from the person viewing the display. Preferably, the display array comprises a lens 17 disposed over each of the holes to magnify or diffuse the light emitted by the second end portion 86 of the fiberoptic strands 19. The lenses 17 are held in place by means of a small amount of an adhesive, such as an epoxy, cyanoacrylate, or other suitable adhesive.

Thus, according to the invention, there is a base portion and a display array portion. The base portion in one preferred form of the invention comprises a horizontal frame member 30, a vertical perimeter frame member 15, a vertical perimeter frame member 18, and a top cover 42, which can be thought of as collectively forming a box-like construction having a hollow interior portion in which are disposed the light source support 20 and fiberoptic guide 28. According to a preferred form of the invention, the top cover 42 of the base portion also serves to block light emitted from the light-emitting sources from escaping the inner confines of the base portion. The fiberoptic guide 28 may function equivalently as the top cover. Such would cause problematic reflections against the rear surface 78 of the display array 21 which could be reflected towards the right in FIG. 1, which would be troublesome in the event a device according to the invention were mounted in the back window of a motorized vehicle, as such reflections would tend to distract the driver of such a vehicle through the rear view mirror. The display array 21 also has a front surface 101 (FIG. 1).

As mentioned above, the light sources or light-emitting diodes 6 are mounted to the light source support 20. In one preferred form of the invention, the light source support is planar in configuration and exists in the shape of a square or rectangle, although other geometries such as circular, oval, or other polygons are within the scope of the invention. The light sources are preferably arranged in an array, for example, in one form of the invention, a rectangular array that comprises 100 light sources in the length dimension and 50 light sources in its width dimension. However, arrays having any number of light sources in the length dimension and any number of light sources in the width dimension are suitable for use in accordance with the present invention. It is preferred that the number of holes 25 in the display array 21 are equal to the number of light sources, such as LED's 6, disposed on the light source support 20 and are also equal to the number of holes in the fiberoptic guide 28. It is preferred that the geometric layout of the holes 25 in the display array 21 is the same as the arrangement of the light sources disposed on the light source support 20, and is also the same arrangement as the holes in the fiberoptic guide 28, as viewed from above. Thus, under such an arrangement, each light source is provided with its own exclusive fiberoptic strand 19, which is held in place by means of an adhesive, such as an epoxy, cyanoacrylate, or other suitable adhesive disposed at its junction with the fiberoptic guide 28. The second end portions 86 of the fiberoptic strands 19 are held in place within the holes 25 on the display array 21 by means of an adhesive, such as an epoxy, cyanoacrylate, or other suitable adhesive.

The fiberoptic strands 19 may be of any length desired. This capability enables the base portion which includes the light sources to be remotely located from the display array 21 itself, in one form of the invention.

Figure 2:
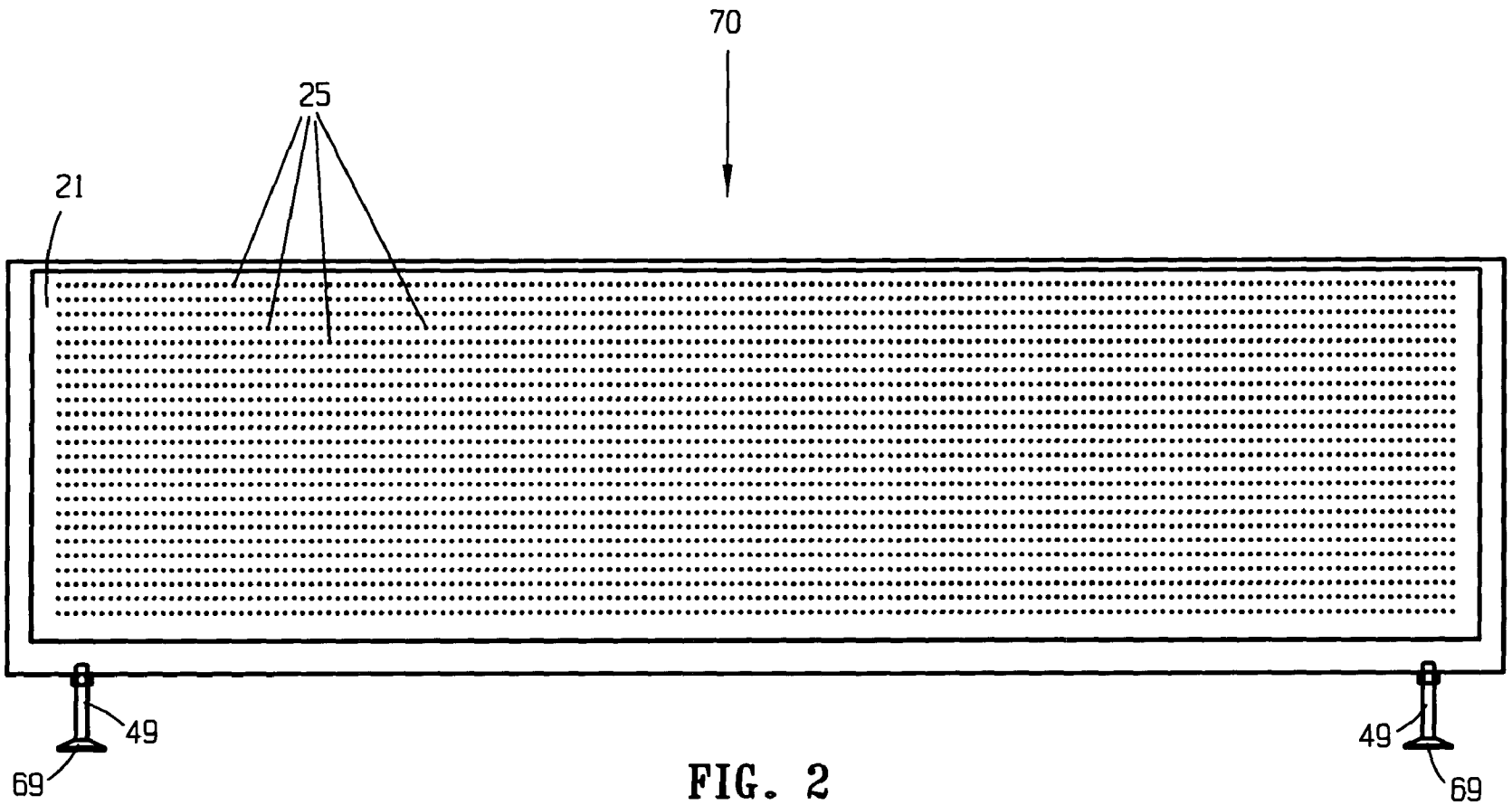
FIG. 2 shows a front perspective view of a display device according to the invention.

FIG. 2 shows a front perspective view of a display device 70 according to the invention. This is the view that a person viewing a message displayed on the display observes. In this figure is shown the display array 21, which in this embodiment is supported by legs 49 having suction cups 69 disposed at their ends. The plurality of holes 25 are shown, which collectively comprise the light display.

Figure 3:
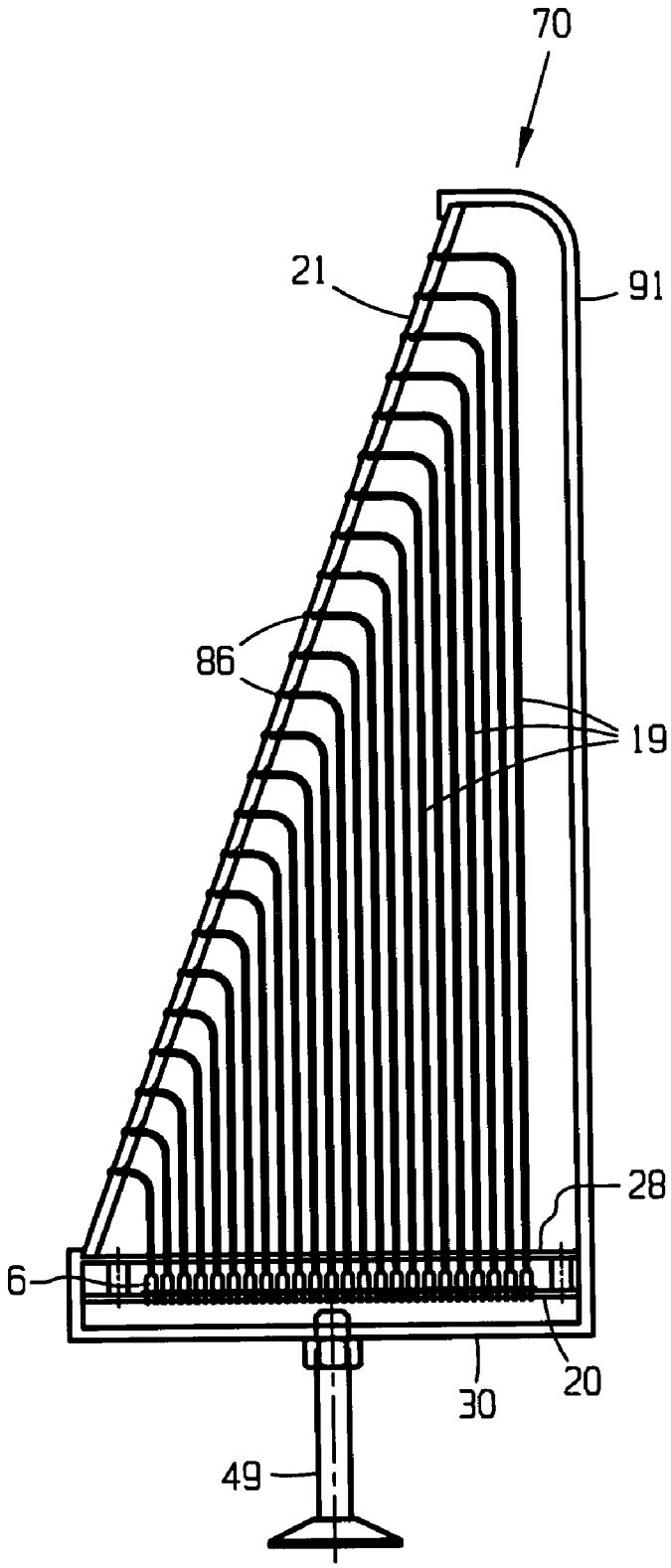
FIG. 3 shows a side schematic view of a display device according to the invention.

FIG. 3 shows another side perspective view of a display device 70 according to the invention. In this view are shown the respective locations of the horizontal frame member 30, light source support 20, fiberoptic guide 28 and light emitting diodes 6. Also shown are the fiberoptic strands 19, display array 21, and second end portions 86 of the fiberoptic strands 19. In this embodiment is also provided a rear cover 91 which encloses the assembly from the external surroundings.

Owing to the translucency of the display array 21 by virtue of its being made from a clear material such as glass or a clear polymer, and owing to the small size of the fiberoptic strands 19, a display device according to the invention is well-suited to be placed in window locations for providing illuminated displays without inhibiting the ability of a person to see through such window. Thus, the present invention finds utility in the rear windows of taxicabs, upon which display it is possible through the invention to display advertising messages.

According to one form of the invention there is provided a mobile display system with a see-through externally viewable display panel which comprises one or more moveable displays, which are operated by means of a controller. The display is moved from location to location by a transporter which may comprise a vehicle, trailer, mobile stand, or a person. The controller drives the display to generate a publicly viewable message selected for viewing within a certain geographical area, for example, a district within a city. The message may be displayed pursuant to a schedule which includes dates, times of day, and display duration while the transported display is within a scheduled area. The display may be operated by an on-board controller which is controlled by a master controller using a wireless connection, wherein the master controller is not onboard the mobile display, but is located at a selected location from which the operator controls the messages on one or more of the mobile displays in use in the area within their purview. The display comprises any of a variety of known electronically driven changeable displays including, for example, LED displays which may be driven in a constantly changeable word string format, such as a "zipper" and may present moveable or still picture quality images, lettering or other graphic formats on a generally planar screen. The use of controllers for this purpose are well-known in the art. Further, a display means according to the invention may be of any pre-selected size currently in use on similar devices of the prior art and may alternatively be supported by a pole, or may be free standing as a sign, or disposed on a tripod, or other means, and need not be transported by a human transporter. It may be secured to the roof of an automobile and/or the inside rear window of an automobile or truck or mounted across the front, sides or rear of a truck, bus, or trailer and/or inside the rear window of a truck or bus.

The invention is contemplated to be used for advertising and possible as a message board for public safety and individuals relating to vehicles, such as, police cars and private citizens' vehicles. In one preferred form of the invention, a police car can employ a display according to the invention to issue orders to other vehicles, or employ warning messages, such as blinking arrows to divert traffic to one side or another of a stopped police vehicle.

Thus, the present invention solves the problems inherent in U.S. Pat. Nos. 6,060,993 and 6,236,330 by addition of a rear-view display, as the present invention is not limited to an LCD screen, as the aforesaid US Patent employ. The present invention is LED only in its preferred embodiment, and may be used in conjunction with other types of roof top displays, or roof top displays comprising the display means of the present invention, wherein the roof top displays are in full color, and the see-through rear display according to the invention being amber in color only, for enhanced safety. When multiple units according to the invention are employed in a display, there may be a different message on each display, i.e., the roof top displays have one message on each side and the see-through rear display has a completely different message, if desired. The invention does what the aforesaid US patent do, plus has the advantage of the rear window see through mobile display panel. This gives the transporter all of the advantages of the rooftop displays plus an additional field of visual display i.e., the rear view. The vehicle operator can see through the rear window and is not obstructed by the sign, even when the sign is in operation.

Figure 4:
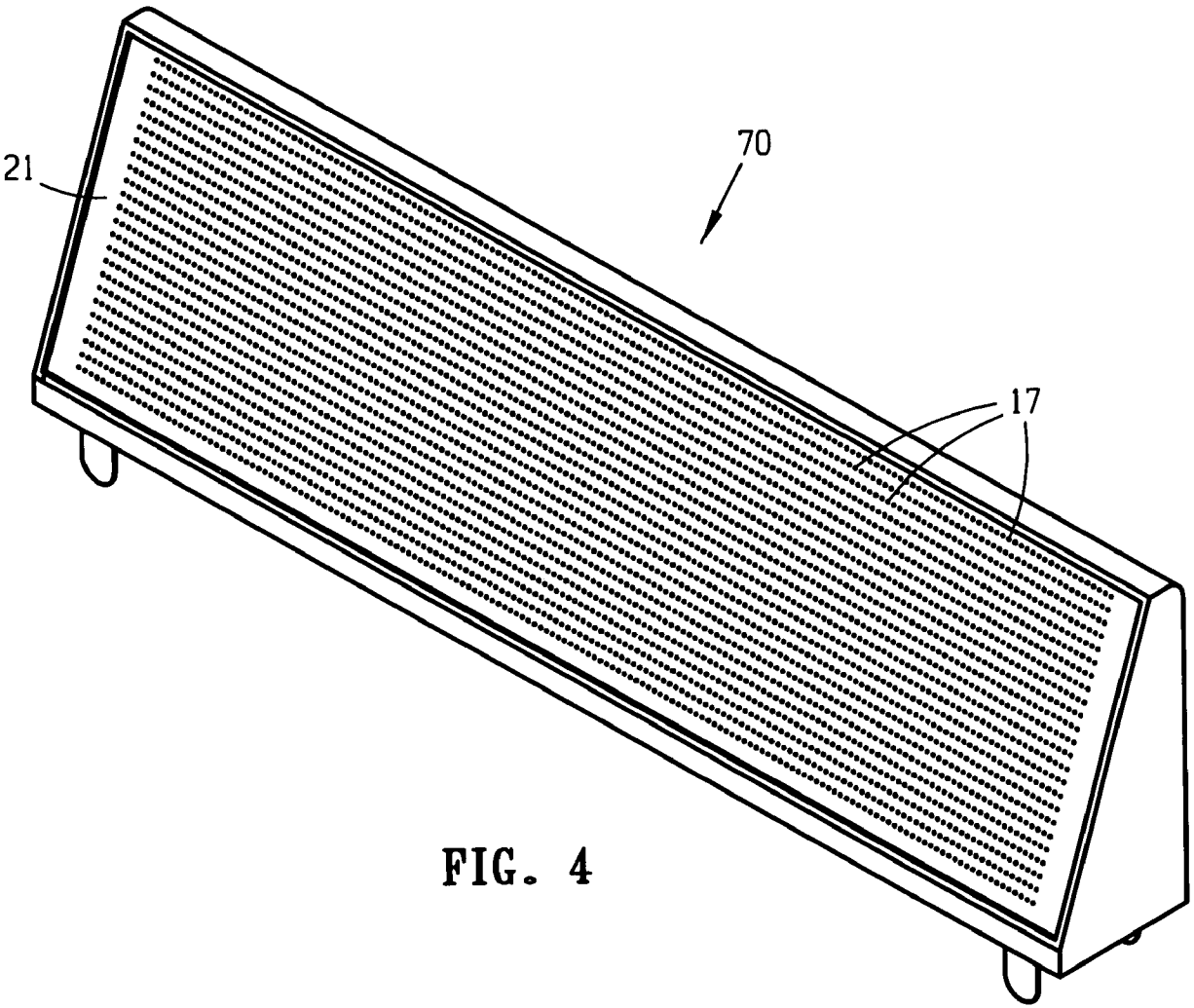
FIG. 4 shows a perspective view of a display device according to the invention.

FIG. 4 shows a front perspective view of a display device 70 according to the invention, showing the clear display array 21, and lenses 17.

Figure 5:
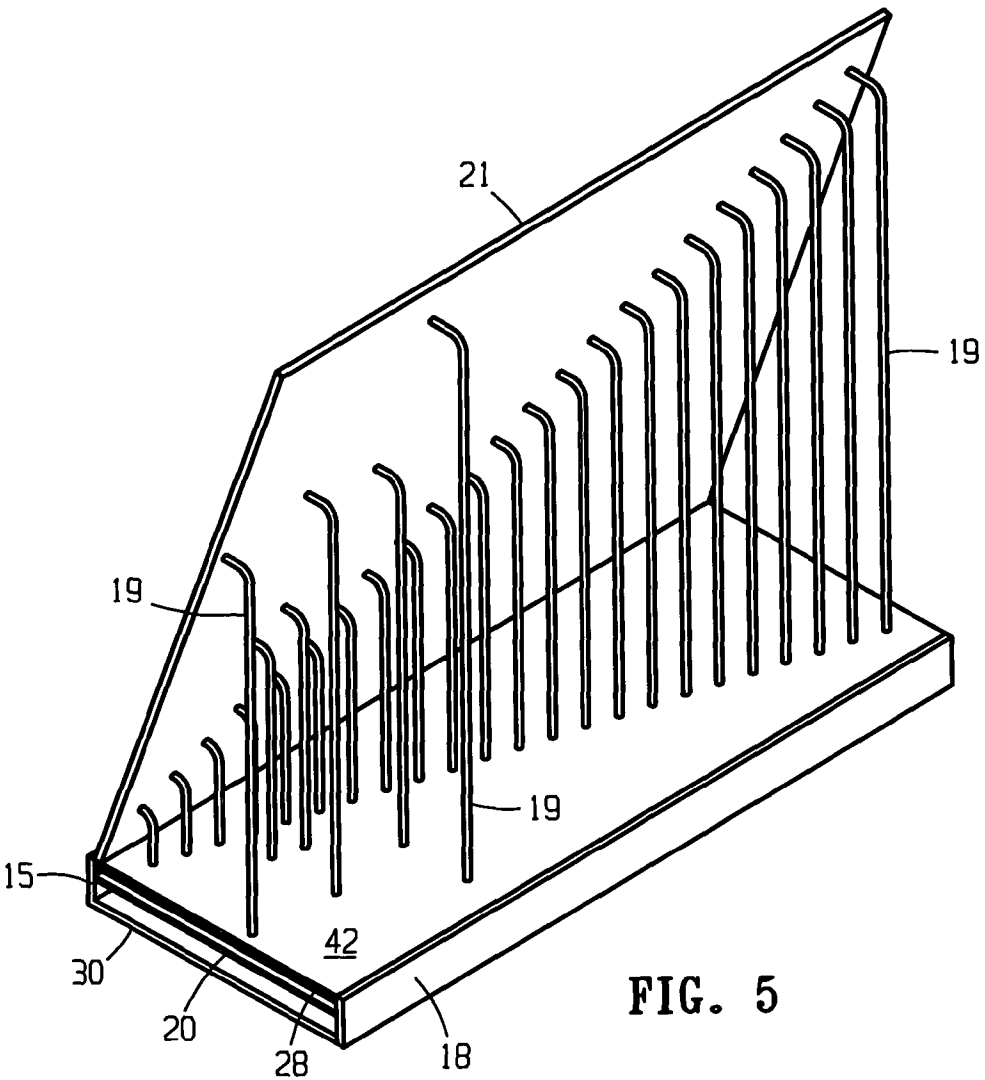
FIG. 5 shows a side perspective view of the rear of a display device according to the invention.

FIG. 5 shows a rear perspective view of a display device 70 according to the invention, including the respective positions of the fiberoptic strands 19, top cover 42, vertical perimeter frame member 18, fiberoptic guide 28, light source support 20, horizontal frame member 30, vertical perimeter frame member 15, and display array 21.

Consideration must be given to the fact that although this invention has been shown, described, and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

What is claimed is:

1. A transparent illuminated display device suitable for mounting in windows and other locations which comprises:

a) a base portion having a bottom surface, a top portion, and a hollow interior portion;

b) a light source support having a plurality of light sources disposed thereon;

c) a substantially-planar fiberoptic guide having a plurality of holes disposed through its surface;

d) a substantially-planar, transparent display array having a plurality of holes disposed through its surface, said substantially-planar display array being attached to said base portion at the top portion of said base portion, such that said substantially planar display array is disposed at an angle of between 30 and 85 degrees with respect to the horizontal when said base portion of said transparent illuminated display is disposed on a horizontal surface; and e) a plurality of fiberoptic strands, wherein each fiberoptic strand has a first end portion and a second end portion, wherein the first end portion of the fiberoptic strands are disposed in sufficient proximity to one of said light sources disposed on said light source support to enable light emitted from the light source to enter the fiberoptic strands, and wherein said second end portion of each of said fiberoptic strands is disposed within one of the holes in said display array, said fiberoptic strands passing through one of said holes disposed through said fiberoptic guide.

2. A device according to claim 1 wherein said display array comprises a front surface and a rear surface, and wherein said fiberoptic strands enter said holes on said display array from the rear surface.

3. A device according to claim 1 wherein said transparent display array comprises a material selected from the group consisting of: polymethylmethacrylate resins, polyethylethacrylate resins, polycarbonate resins, polyacrylate resins, and glass.

4. A device according to claim 1 further comprising a lens disposed at said second end portion of said fiberoptic strands.

5. A device according to claim 4 wherein said lens is in contact with said display array.

6. A device according to claim 4 wherein said lens is affixed to said display array by means of an adhesive.

7. A device according to claim 1 wherein said display array is transparent to the extent that it absorbs less than 5.0% of visible light passing through a one centimeter length of said display array.

8. A device according to claim 1 wherein said plurality of light sources comprise light emitting diodes.

9. A device according to claim 1 wherein said plurality of light sources comprise light emitting diodes and wherein said light emitting diodes are arranged in a rectangular array.

10. A device according to claim 1 wherein said plurality of holes disposed through the surface of said transparent display array are arranged in a rectangular array.

11. A device according to claim 9 wherein said plurality of holes disposed through the surface of said transparent display array are arranged in a rectangular array.

12. A transparent illuminated display device suitable for mounting in windows and other locations which comprises:

a) a base portion having a bottom surface, a top portion, and a hollow interior portion;

b) a light source support having a plurality of light sources disposed thereon, wherein said plurality of light sources comprise light emitting diodes, wherein said light emitting diodes are arranged in a rectangular array;

c) a substantially-planar fiberoptic guide having a plurality of holes disposed through its surface;

d) a substantially-planar, transparent display array having a plurality of holes disposed through its surface, wherein said holes through the surface of said transparent display are arranged in a rectangular array, said substantially-planar display array being attached to said base portion at the top portion of said base portion, such that said substantially planar display array is disposed at an angle of between 30 and 85 degrees with respect to the horizontal when said base portion of said transparent illuminated display is disposed on a horizontal surface, and wherein said transparent display array comprises a material selected from the group consisting of: polymethylmethacrylate resins, polyethylethacrylate resins, polycarbonate resins, polyacrylate resins, and glass;

e) a plurality of fiberoptic strands, wherein each fiberoptic strand has a first end portion and a second end portion, wherein the first end portion of the fiberoptic strands are disposed in sufficient proximity to one of said light sources disposed on said light source support to enable light emitted from the light source to enter the fiberoptic strands, and wherein said second end portion of each of said fiberoptic strands is disposed within one of the holes in said display array, said fiberoptic strands passing through one of said holes disposed through said fiberoptic guide; and f) a lens disposed at said second end portion of said fiberoptic strands.

13. A process for displaying a character comprising the steps of:

i) transparent illuminated display device suitable for mounting in windows and other locations which comprises:

a) a base portion having a bottom surface, a top portion, and a hollow interior portion;

b) a light source support having a plurality of light sources disposed thereon;

c) a substantially-planar fiberoptic guide having a plurality of holes disposed through its surface;

d) a substantially-planar, transparent display array having a plurality of holes disposed through its surface, said substantially-planar display array being attached to said base portion at the top portion of said base portion, such that said substantially planar display array is disposed at an angle of between 30 and 85 degrees with respect to the horizontal when said base portion of said transparent illuminated display is disposed on a horizontal surface; and e) a plurality of fiberoptic strands, wherein each fiberoptic strand has a first end portion and a second end portion, wherein the first end portion of the fiberoptic strands are disposed in sufficient proximity to one of said light sources disposed on said light source support to enable light emitted from the light source to enter the fiberoptic strands, and wherein said second end portion of each of said fiberoptic strands is disposed within one of the holes in said display array, said fiberoptic strands passing through one of said holes disposed through said fiberoptic guide; and ii) selectively energizing a plurality of said light sources in a pre-selected pattern so as to cause a first image to be displayed on said display array.

14. A process according to claim 13 wherein said first image comprises a character selected from the group consisting of: numbers and letters.

15. A process according to claim 13 further comprising the step of:

iii) causing said image displayed on said display array to cease to exist; and iv) selectively energizing a plurality of said light sources in a pre-selected pattern so as to cause a second image to be displayed on said display array, wherein said second image is different than said first image.

* * * * *